US009046315B2

(12) United States Patent
Rivoli et al.

(10) Patent No.: US 9,046,315 B2
(45) Date of Patent: Jun. 2, 2015

(54) NON-MARRING GUN HOOK

(71) Applicants: Leslie K. Rivoli, Cedar Hill, MO (US); Louis D. Rivoli, Cedar Hill, MO (US)

(72) Inventors: Leslie K. Rivoli, Cedar Hill, MO (US); Louis D. Rivoli, Cedar Hill, MO (US)

( * ) Notice: Subject to any disclaimer, the term of this patent is extended or adjusted under 35 U.S.C. 154(b) by 0 days.

(21) Appl. No.: 14/067,128

(22) Filed: Oct. 30, 2013

(65) Prior Publication Data

US 2015/0113850 A1 Apr. 30, 2015

(51) Int. Cl.

| | |
|---|---|
| ***A47B 81/00*** | (2006.01) |
| ***F41A 23/18*** | (2006.01) |
| *A47F 5/08* | (2006.01) |

(52) U.S. Cl.

CPC ..... *F41A 23/18* (2013.01); *A47F 5/0815* (2013.01); *A47F 5/0823* (2013.01); *A47B 81/005* (2013.01); *Y10S 224/912* (2013.01)

(58) Field of Classification Search

CPC ... A47F 5/0815; A47F 5/0006; A47F 5/0823; A47B 81/005; Y10S 224/912

USPC ..... 248/220.41, 220.31, 220.42, 220.43, 248/302, 303, 301, 304, 309.1; 211/59.01, 211/64, 106.01; 224/242, 243, 248, 301, 224/546, 912; D8/373, 367

See application file for complete search history.

(56) References Cited

U.S. PATENT DOCUMENTS

| | | | | | |
|---|---|---|---|---|---|
| 305,861 | A | * | 9/1884 | Taylor | 248/303 |
| 2,761,644 | A | * | 9/1956 | Bruno | 248/303 |
| 2,778,588 | A | * | 1/1957 | Bruno | 248/302 |
| 3,037,733 | A | * | 6/1962 | Roman | 248/220.43 |
| 3,985,324 | A | | 10/1976 | Larson | |
| 4,516,681 | A | * | 5/1985 | Jahel | 211/59.1 |
| 4,942,989 | A | * | 7/1990 | Miller | 224/546 |
| D312,384 | S | | 11/1990 | Hamann | |
| 5,026,011 | A | * | 6/1991 | Hoefkes | 248/220.41 |
| D349,042 | S | * | 7/1994 | Costello | D8/373 |
| 5,600,913 | A | | 2/1997 | Minneman | |
| 6,189,847 | B1 | * | 2/2001 | Hart | 248/220.31 |
| 6,349,909 | B1 | * | 2/2002 | Zarrow et al. | 248/220.41 |
| 7,427,053 | B2 | | 9/2008 | Nawrocki | |
| 8,191,845 | B1 | * | 6/2012 | Yu | 248/304 |
| 8,292,094 | B2 | * | 10/2012 | Morton | 211/64 |
| 2004/0195192 | A1 | * | 10/2004 | Belokin et al. | 211/59.1 |
| 2005/0218280 | A1 | | 10/2005 | Rojas | |

* cited by examiner

*Primary Examiner* — Tan Le
(74) *Attorney, Agent, or Firm* — Polster Lieder

(57) ABSTRACT

The present disclosure provides a device for supporting and displaying a handgun. In various embodiments, the device comprises a moisture barrier back plate, a pair of opposing looped fingers extending from the back plate, and at least one retention hook extending from a top portion of the back plate. Each looped finger comprises an upper support arm and a lower support arm, and each retention hook is structured and operable to be disposed within a hole in a display panel to connect and retain the device on the display panel. The device is fabricated of a non-marring material, e.g., a polymer or synthetic material such as Acrylic, Nylon 6, Carbon Fiber, etc., that will not scratch, abrade or mar any portion of the firearm.

7 Claims, 2 Drawing Sheets

NON-MARRING GUN HOOK

FIELD

The present teachings relate to handgun holding and displaying devices, particularly to a non-marring peg-board hook structured and operable to hold, display and support substantially any handgun without marring the finish of the respective handgun.

BACKGROUND

The statements in this section merely provide background information related to the present disclosure and may not constitute prior art.

Typically, known systems, devices and apparatuses for storing and/or displaying handguns, e.g., racks, safes, mounts and hooks, present certain challenges to handgun owners in that they do not generally provide easy access to, or storage of, the respective handguns. Additionally, such known systems, devices and apparatuses are typically expensive, can often scratch and/or scuff the respective handgun, and can retain undesired moisture between the system, device or apparatus and the respective handgun.

SUMMARY

The present disclosure provides a device for supporting and displaying a handgun. In various embodiments, the device comprises a moisture barrier back plate, a pair of opposing looped fingers extending from the back plate, and at least one retention hook extending from a top portion of the back plate. Each looped finger comprises an upper support arm and a lower support arm, and each retention hook is structured and operable to be disposed within a hole in a display panel to connect and retain the device on the display panel. The device is fabricated of a non-marring material, e.g., a polymer or synthetic material such as Acrylic, Nylon 6, Carbon Fiber, etc., that will not scratch, abrade or mar any portion of the firearm.

Further areas of applicability of the present teachings will become apparent from the description provided herein. It should be understood that the description and specific examples are intended for purposes of illustration only and are not intended to limit the scope of the present teachings.

DRAWINGS

The drawings described herein are for illustration purposes only and are not intended to limit the scope of the present teachings in any way.

Corresponding reference numerals indicate corresponding parts throughout the several views of drawings.

DETAILED DESCRIPTION

Figure 1:
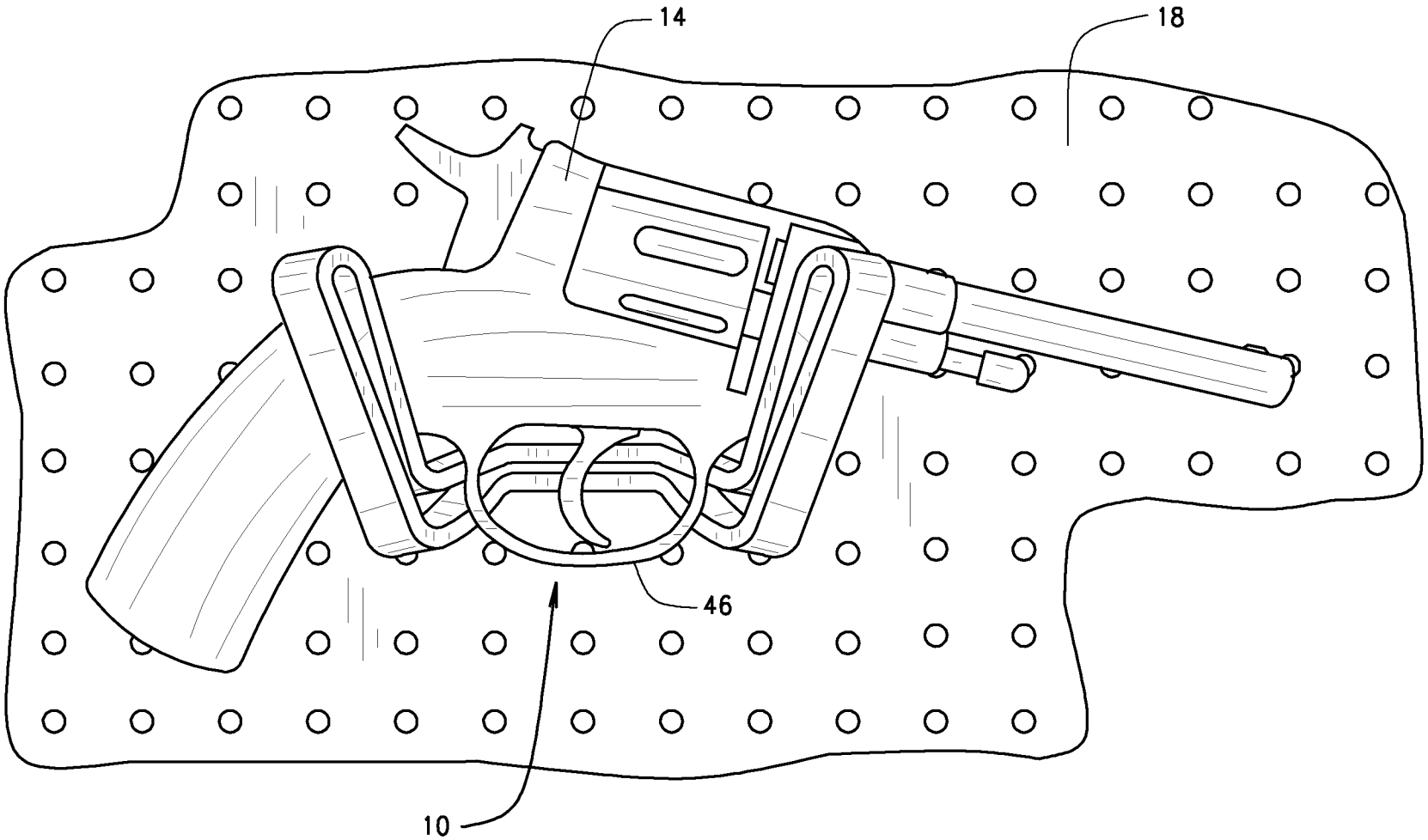
FIG. 1 is an illustration of a non-marring firearm retention and display device have a firearm disposed and retained therein, in accordance with various embodiments of the present disclosure.

The following description is merely exemplary in nature and is in no way intended to limit the present teachings, application, or uses. Throughout this specification, like reference numerals will be used to refer to like elements.

Referring now to FIG. 1, the present disclosure provides a non-marring firearm retention and display device 10 that is structured and operable to retain and display a firearm 14, e.g., a handgun, on a display panel 18, e.g., a pegboard. The device 10 is fabricated of a non-marring material, e.g., a synthetic or polymer material such as Acrylic, Nylon 6, Carbon Fiber, etc., that will not scratch, abrade or mar any portion of the firearm 14. Additionally, in various embodiments, the device 10 is fabricated of a substantially transparent material, e.g., a synthetic or polymer material such as Acrylic, Nylon 6, Carbon Fiber, etc., that will not obscure viewing of any portion the firearm 14, when the firearm 14 is disposed within the device 10.

Figure 2:
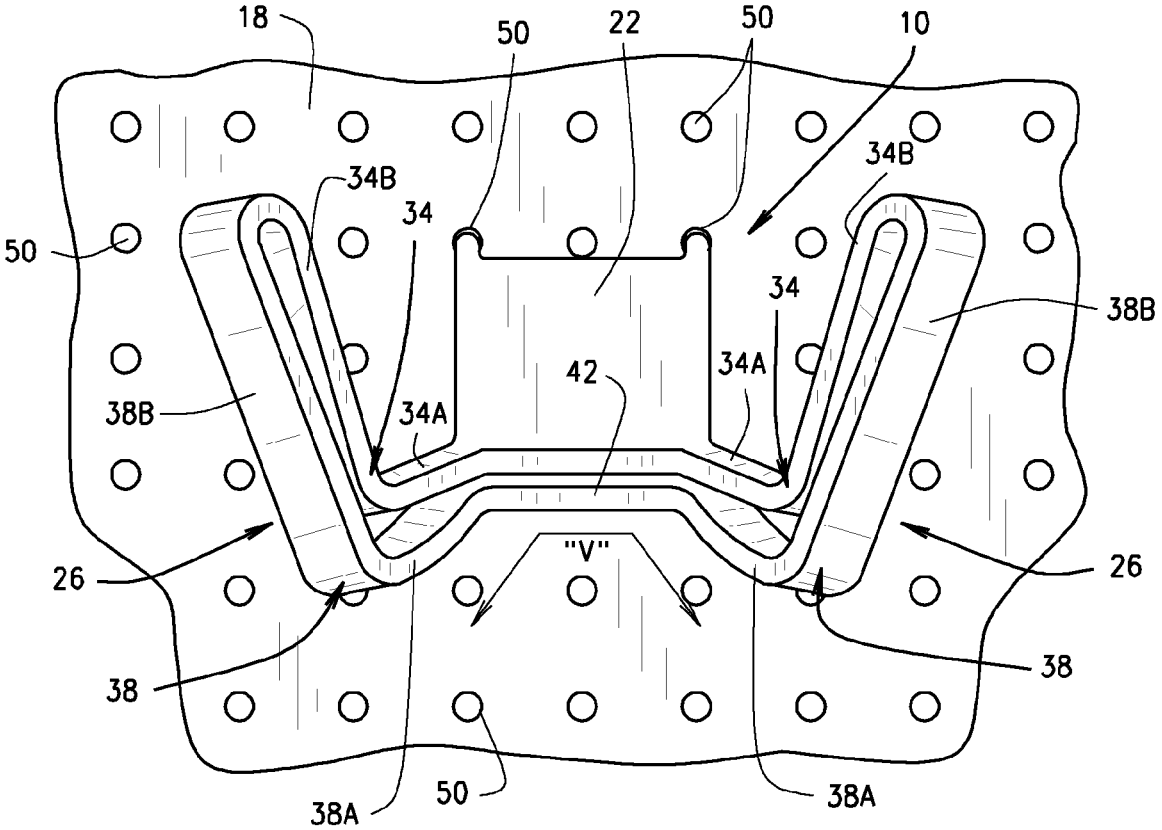
FIG. 2 is a front view of the non-marring firearm retention and display device shown in FIG. 1, in accordance with various embodiments of the present disclosure.
Figure 3:
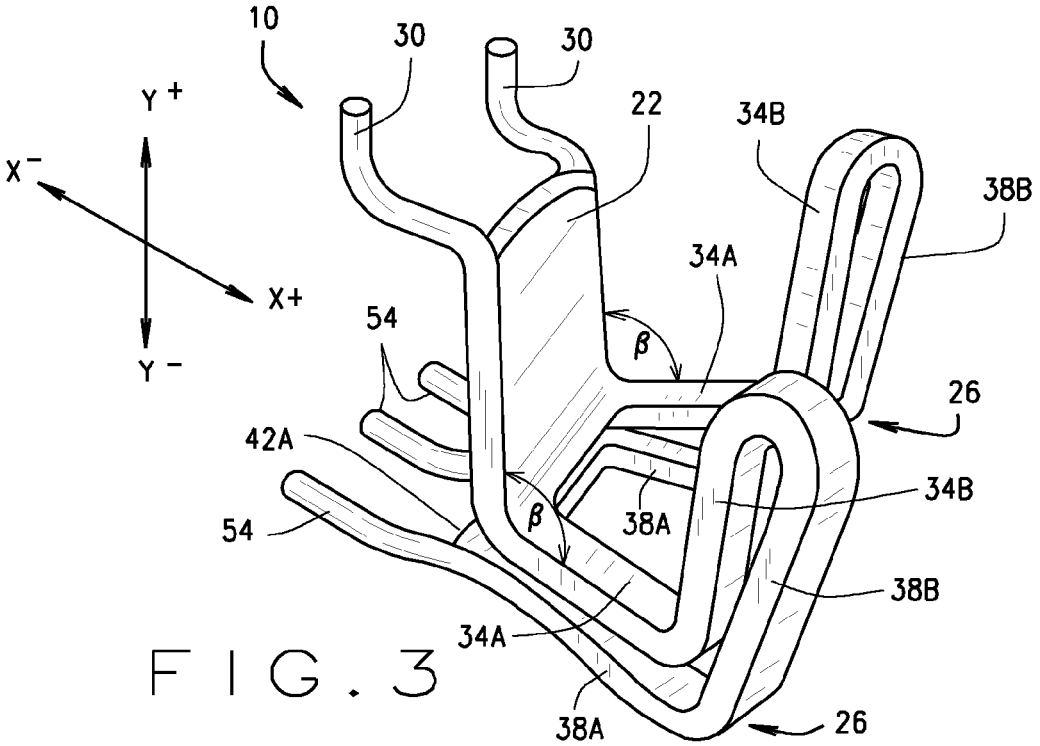
FIG. 3 is a side view of the non-marring firearm retention and display device shown in FIG. 1, in accordance with various embodiments of the present disclosure.

Referring now to FIGS. 2 and 3, generally, the device 10 includes a moisture barrier back plate 22, a pair of opposing looped firearm support fingers 26 extending somewhat orthogonally forward from a bottom portion of the back plate 22, and at least one retention hook 30, e.g., one, two, three or more retention hooks 30, extending substantially orthogonally backward from a top portion of the back plate 22 (i.e., in an opposite direction from the from looped fingers 26). As used herein, upper and top will be understood to mean the $Y^+$ direction, lower and bottom will be understood to mean the $Y^-$ direction, front and forward will be understood to mean the $X^+$ direction, and rear and backward will be understood to mean the $X^-$ direction, as illustrated in FIG. 3.

The looped fingers 26 each comprise an upper support arm 34 and a lower support arm 38. The upper support arms 34 extend from a bottom portion, or bottom edge, of the back plate 22. Particularly, the upper support arms 34 can be connected to, or integrally formed with the bottom portion of the backing plate 22. Each upper support arm 34 includes a firearm rest leg 34A on which the firearm 14 rests or sits when disposed within the looped fingers 26, and a firearm retention leg 34B that prevents the firearm 14 from falling forward off the firearm rest legs 34A. More specifically, the firearm rest legs 34A extend from (i.e., are connected to or are integrally formed with) the bottom portion of the backing plate 22, and the firearm retention legs 34B extend at an upward angle from (i.e., are connected to or are integrally formed with) the rest legs 34A. The firearm retention legs 34B can extend upward from the firearm rest legs 34A at an acute angle, a right angle, or an obtuse angle relative to the firearm rest legs 34A such that when the firearm 14 is resting or setting on the firearm rest legs 34 (i.e., disposed/retained within the looped fingers 26), the firearm 14 cannot rotate forward and fall off of the firearm rest legs 34A (i.e., cannot fall out of the looped fingers 26).

In various embodiments, the firearm rest legs 34A extend from the bottom portion of the back plate 22 at an acute angle $\beta$, i.e., less than 90°, e.g., 60° to 85°. Therefore, when the firearm 14 is disposed within the looped fingers 26 (i.e., retained and displayed by the device 10 and resting on the firearm rest legs 34A) the angle $\beta$ will cause the firearm 14 to lean backward and rest against the back plate 22 such that the firearm 14 will not easily rotate forward due to vibration or movement of the display panel 14.

The lower support arms 38 are connected to, or integrally formed with the upper support arms 34 at distal ends of lower support arms 38 and are structured to rest against the display panel 18 at proximal ends of the lower support arms 38. More particularly, the proximal ends of the lower support arms 38 are connected by a bridge 42 such that a back edge 42A of the bridge 42 will contact and rest against the display panel 18 when the device 10 is connected to the display panel 18, as described herein. Importantly, by contacting and resting against the display panel 18, the bridge 42 and lower support arms provide rigid support to the upper support arms 34 to support the weight of the firearm 14 when the firearm 14 is disposed in the device 10. More specifically, via the connection of the rest legs 34A to the back plate 22, the upper support arms 34 provide a first level, or axis, of support to the upper support arms 34 for supporting the weight of the firearm 14, and via the connection of the lower support arms 38 to the upper support arms 34 and the contact of the bridge 42 against the display panel 18, the lower support arms 38 provide a second level, or axis, of support to the upper support arms for supporting the weight of the firearm 14. Hence, the device 10 is structured and operable to provide two levels, or axes, of support for supporting the weight of the firearm 14 such that the device 14 can be utilized to support, store and/or display various sizes and weights of firearms 14.

In various embodiments, the lower support arms 38 comprise a lateral leg 38A extending from (i.e., connected to or are integrally formed with) the bridge 42 and an upright leg 38B that extends from (i.e., connected to or are integrally formed with) the lateral leg 38A and connects to the upper support arm 34 such that the lower support arm 38 provides the second layer, or axis, of support to the upper support arm 34. More specifically, in such embodiments, a distal end of each lower support arm upright leg 38B extends from (i.e., connected to or are integrally formed with) the distal end of the respective upper support arm retention leg 34B. That is, the lower support arms 38 can be connected to, joined with, extend from, or integrally formed with the upper support arms 34 to generally form a single structure that transitions from upper support arm 34 to the lower support arm 38. Therefore, stresses or forces acting on the upper support arms 34 that are transmitted to, or present at, the distal ends of the retention legs 34B will be transmitted or transferred, via the connection of the upper support arm retention legs 34B to the lower support arm upright legs 38B, to the lower support arms 38 and resisted, countered or terminated via the contact of the bridge 42 with the display panel 18. Specifically, the lower support arms 38 provide support to the upper support arms 38 via the connection of the lower support arm upright legs 38B with the upper support arm retention legs 34B and the contact of the bridge 42 (having lower support arm lateral legs 38A extending there from) with the display panel 18. Therefore, as described above, the device 10 provides two levels, or axes, of support for supporting the weight of the firearm 14 such that the device 14 can be utilized to support, store and/or display various sizes and weights of firearms 14.

To dispose and retain the firearm 14 within the device 10, a trigger guard 46 of the firearm 14 is placed between the opposing looped fingers 26, as illustrated in FIG. 1. In various embodiments the opposing looped fingers 26 extend outward from the back plate 22 and the bridge 22 at an angle relative to each other to form truncated 'V'. Particularly, the proximal ends of the opposing looped fingers 26 (i.e., proximal ends of the opposing upper support arm rest legs 34A and the proximal ends of the opposing lower arm lateral legs 38B) are in closer proximity to each other than the medial ends of the opposing looped fingers 26 (i.e., the distal ends of the opposing upper support arm rest legs 34A and the distal ends of the opposing lower arm lateral legs 38B), thereby forming the truncated 'V' shape. The truncated 'V' shape of the opposing looped fingers 26 allows the device 10 to accommodate firearms 14 of different sizes. More specifically, because the opposing looped fingers 26 extend outward at an angle away from each other, forming the truncated 'V', firearms 14 having different size trigger guards 46 can be accommodated between the opposing looped fingers 26. That is, smaller trigger guards 46 will fit between the opposing looped fingers 26 nearer the base of the truncated 'V' (i.e., nearer the back plate 22), and larger trigger guards 46 will fit between the opposing looped fingers 26 nearer the mouth of the truncated 'V' (i.e., nearer the medial ends of the looped fingers 26).

As described above, the device 10 includes at least one retention hook 30, e.g., two, three or more retention hooks 30, that extend substantially orthogonally backward from the top portion of the back plate 22. More specifically, each retention hook 30 is sized to fit within a respective one of a plurality of holes 50 in the display panel 18 and formed to have an 'L' shape such that each retention hook 30 is structured and operable to be disposed within a respective hole 50 to connect and retain the device 10 on the display panel 18. Particularly, to connect and retain the device 10 on the display panel, a distal end of each retention hook 30 is inserted through a respective hole 50, whereafter the orientation of the device 10 is manipulated until substantially the entire length of each retention hook 30 has passed through the respective hole 50 such that the 'L' shape of each retention hook 30 'hooks' (i.e., connects and retains) the device 10 to display panel 18. When the device 10 is connected and retained on the display panel 18, at least a portion of the back plate 22 rests against the display panel 22, as illustrated in FIG. 2.

In various embodiments, the device 10 includes at least one stabilizing pin 54, i.e., e.g., one, two, three or more stabilizing pins 54 that extends from the back edge of the bridge 42. The stabilizing pin(s) 54 is/are structured and operable to be disposed within a respective one of the holes 50 in the display panel 18 to stabilize an orientation of the device 10 on the display panel 22. More specifically, when the stabilizing pin (s) 54 is/are disposed within a respective one of the holes 50, as illustrated in FIG. 2, the stabilizing pin(s) 54 prevent rotation of the device 10 such that the device 10 will be held in a steady orientation on the display panel 18 when the firearm 14 is disposed therein. Moreover, the stabilizing pins 54 will prevent movement of the bridge 42 in the Y+and Y−directions, thereby providing more stability and support to the upper support arms 34, via the second level, or axis, of support provided by the lower support arms 38, as described above.

As also described above, the device 10 is fabricated of a non-marring material, e.g., a synthetic or polymer material such as Acrylic, Nylon 6, Carbon Fiber, etc., that will not scratch, abrade or mar any portion of the firearm 14. Moreover, in various embodiments, the non-marring material is a non-porous, non-corrosive material such that the device 10, particularly the back plate 22, will not retain condensation or moisture that can oxidize the metal of the firearm 14. More particularly, the back plate 22, constructed of such non-marring, non-porous, non-corrosive material will provide a non-marring moisture barrier between the firearm 14 and the display panel 22, thereby preventing the firearm 14 from contacting any moisture or condensation that may collect on and/or be retained by the display panel 22.

Hence, as described herein, the present disclosure provides the non-marring, one-size-fits-all firearm retention and display device 10. The device 10 is structure and operable for safely storing and displaying all varieties, sizes, shapes and weights of firearm 14 without scratching, abrading or marring the firearm 14. Additionally, the construction of looped fingers 26 provide two distinct levels, or axes, of support to stably support, retain and display the firearm 14 on display panel 18. The looped fingers 26 hold the firearm 14 both fore and aft of the trigger guard 46, but do not go through the trigger guard 46. Furthermore, the device 10 provides the moisture barrier back plate 22 that prevent contact of the firearm 14 with the display panel 18 such that the firearm 14 will not contact moisture on or retained by the display panel 18.

Still further, the looped design of the looped fingers 26 allow for vertical flexibility and adjustment when aligning and inserting the retention hook(s) 30 and the stabilizing pin(s) 54 into the holes 50 of the display panel. That is, the semi-flexible nature of the non-marring polymer or synthetic material, e.g., Acrylic, Nylon 6, Carbon Fiber, etc., and the looped design of the looped fingers 26 the upper support arms 34 and the lower support arms 38 to compressed or stretched apart relative to each other to allow the retention hook(s) 30 and the stabilizing pin(s) 54 to align with and be inserted into the holes 50 of the display panel 18. Finally, as described above, the device 10 can be fabricated from a substantially transparent material, e.g., polymer or synthetic material such as Acrylic, Nylon 6, Carbon Fiber, etc., that will not obscure viewing of any portion the firearm 14, when the firearm 14 is disposed within the device 10.

The description herein is merely exemplary in nature and, thus, variations that do not depart from the gist of that which is described are intended to be within the scope of the teachings. Such variations are not to be regarded as a departure from the spirit and scope of the teachings.

What is claimed is:

1. A device for supporting and displaying a handgun, said device comprising:

a moisture barrier back plate;

a pair of opposing flexible looped fingers extending from a bottom portion of the back plate, each flexible looped finger comprising an upper support arm and a lower support arm, the upper support arm extending from the bottom portion of the back plate at a proximal end thereof and connected at a distal end to a distal end of the lower support arm such that a flexible loop is formed by the upper and lower support arm distal ends whereby the lower support arm of each flexible looped finger is structured and operable to follow the contour and length of the respective upper support arm and to contact a display panel beneath a bottom edge of the back plate; and at least one retention hook extending from a top portion of the back plate, the at least one retention hook structured and operable to be disposed within a hole in the display panel to connect and retain the device on the display panel.

2. The device of claim 1 further comprising at least one stabilizing pin extending from a bridge connecting the proximal ends of the lower support arms, the at least one stabilizing pin structured and operable to be disposed within a hole in the display panel to stabilize an orientation of the device on the display panel.

3. The device of claim 2, wherein the bridge comprises a back edge structured and operable to rest against the display panel such that the lower arm of each looped fingers provides support to the respective upper support arm.

4. The device of claim 1, wherein the upper support arms extend from the back plate at an upward angle such that a gun disposed on the looped fingers will be tilted toward and rest against the back plate.

5. The device of claim 1, wherein the looped fingers extend outward from the back plate at an angle relative to each other to form truncated 'V' wherein the proximal ends of the looped fingers are in closer proximity to each other than medial ends of the looped fingers.

6. The device of claim 1, wherein the device is constructed of a material that will not abrade any portion of a gun disposed within the looped fingers.

7. The device of claim 1, wherein the back plate is structured and operable to protect the firearm from exposure to moisture collected on the display panel.

* * * * *